US009739252B1

(12) United States Patent
Huberts et al.

(10) Patent No.: US 9,739,252 B1
(45) Date of Patent: Aug. 22, 2017

(54) SYSTEM AND METHOD FOR DETECTING ENGINE KNOCK AND MISFIRE

(71) Applicant: Ford Global Technologies, LLC, Dearborn, MI (US)

(72) Inventors: Garlan J. Huberts, Milford, MI (US); Qiuping Qu, Troy, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 2 days.

(21) Appl. No.: 15/048,186

(22) Filed: Feb. 19, 2016

(51) Int. Cl.
*F02P 9/00* (2006.01)
*F02P 17/12* (2006.01)

(52) U.S. Cl.
CPC ..... *F02P 17/12* (2013.01); *F02P 9/002* (2013.01)

(58) Field of Classification Search
CPC F02P 17/12; F02P 9/002; F02P 3/0853; F02P 2017/125; F02P 2017/128; F02P 1/08
USPC ..... 123/605, 609, 618, 634; 361/247, 253; 73/114.67
See application file for complete search history.

(56) References Cited

U.S. PATENT DOCUMENTS

| | | | |
|---|---|---|---|
| 6,424,155 | B1 | 7/2002 | Puettmann et al. |
| 6,691,555 | B2 | 2/2004 | Ohkama et al. |
| 2006/0201475 | A1 | 9/2006 | Shiraishi |
| 2014/0102412 | A1 | 4/2014 | Czekala et al. |
| 2016/0047353 | A1 | 2/2016 | Huberts et al. |

OTHER PUBLICATIONS

Huberts, Garlan J. et al., "System and Method for Operating an Ignition System," U.S. Appl. No. 14/808,819, filed Jul. 24, 2015, 45 pages.

*Primary Examiner* — Hai Huynh
(74) *Attorney, Agent, or Firm* — Julia Voutyras; McCoy Russell LLP

(57) ABSTRACT

A system and method for providing multiple commands to an ignition coil driver circuit to provide spark, ion signal integration, and ignition coil shunting during a cycle of a cylinder is presented. In one example, multiple voltage pulses are provided over a single conductor communication link. The voltage pulses provide encoded instructions for ignition timing, ignition coil shunting, and ion signal integration.

20 Claims, 5 Drawing Sheets

SYSTEM AND METHOD FOR DETECTING ENGINE KNOCK AND MISFIRE

FIELD

The present description relates to a system and method for detecting engine knock and misfire of a spark ignited engine. The system and method may be particularly useful for engines that operate lean or with dilute mixtures.

BACKGROUND AND SUMMARY

A spark plug may provide energy to begin combustion within a cylinder of an engine. In particular, a voltage potential may develop across electrodes of a spark plug. If the voltage potential is greater than a threshold, a spark may be created between spark plug electrodes, thereby facilitating ignition of an air-fuel mixture in a cylinder. Ignition of the air-fuel mixture provides engine torque and may result in engine knock. Engine knock may be produced when end gases of a cylinder air-fuel mixture ignite due to increases in temperature and pressure in the cylinder. The ignition of end gas may result in high frequency cylinder pressure oscillations that provide an engine knocking sound. An ignition coil secondary winding may be monitored via ion sensing circuitry to determine if engine knocking is present. However, some higher output ignition coils have higher inductance windings that may cause engine knock sensing to be more challenging. Further, an ion signal may be integrated to estimate engine combustion quality or misfire.

If a conductor is provided between a controller that issues spark timing commands and ignition circuitry for each command signal, a number of conductors in the system may increase rapidly. Further, multiple circuits may have to be supplied to determine spark timing, ignition coil shunting, and ion sensor output. Consequently, it may be difficult and/or less reliable to provide a desired level of ignition system sophistication.

The inventors herein have recognized the above-mentioned disadvantages and have developed a method for providing spark to an engine, comprising: receiving input from one or more engine sensors to a controller; and commanding via the controller shunting, charging, and discharging of an ignition coil during a cylinder cycle in response to the input, the commanding accomplished via a single conductor providing electrical communication between the controller and an ignition coil drive circuit.

By providing multiple ignition circuit commands over a single conductor, it may be possible to reduce a number of conductors between a controller and ignition circuitry. The reduced number of conductors may reduce wiring issues and lower system cost. Further, a lower number of conductors within the engine system may improve vehicle reliability. In particular, a single conductor positioned between a controller and an ignition circuit may carry three or more encoded voltage pulses that provide ignition timing, ignition coil shunt timing, and ion signal integration timing. The voltage pulses are carried by the single sole conductor during a cycle of the engine so that ignition, ignition coil shunting, and ion signal integration may be performed during a single cylinder cycle. Further, the pulses may be modified each engine cycle to adjust spark timing, adjust ignition coil shunting timing, and adjust ion signal integration timing.

The present description may provide several advantages. In particular, the approach reduces the number of conductors in an engine system. Further, the approach may improve system reliability by reducing a number of electrical system connections in the system. Further still, the approach may simplify circuitry to decode ignition timing, ignition coil shunting, and ion signal integration because only a single decoding circuit is used to determine ignition system timing signals sent via a controller.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an example, referred to herein as the Detailed Description, when taken alone or with reference to the drawings, where.

DETAILED DESCRIPTION

Figure 1:
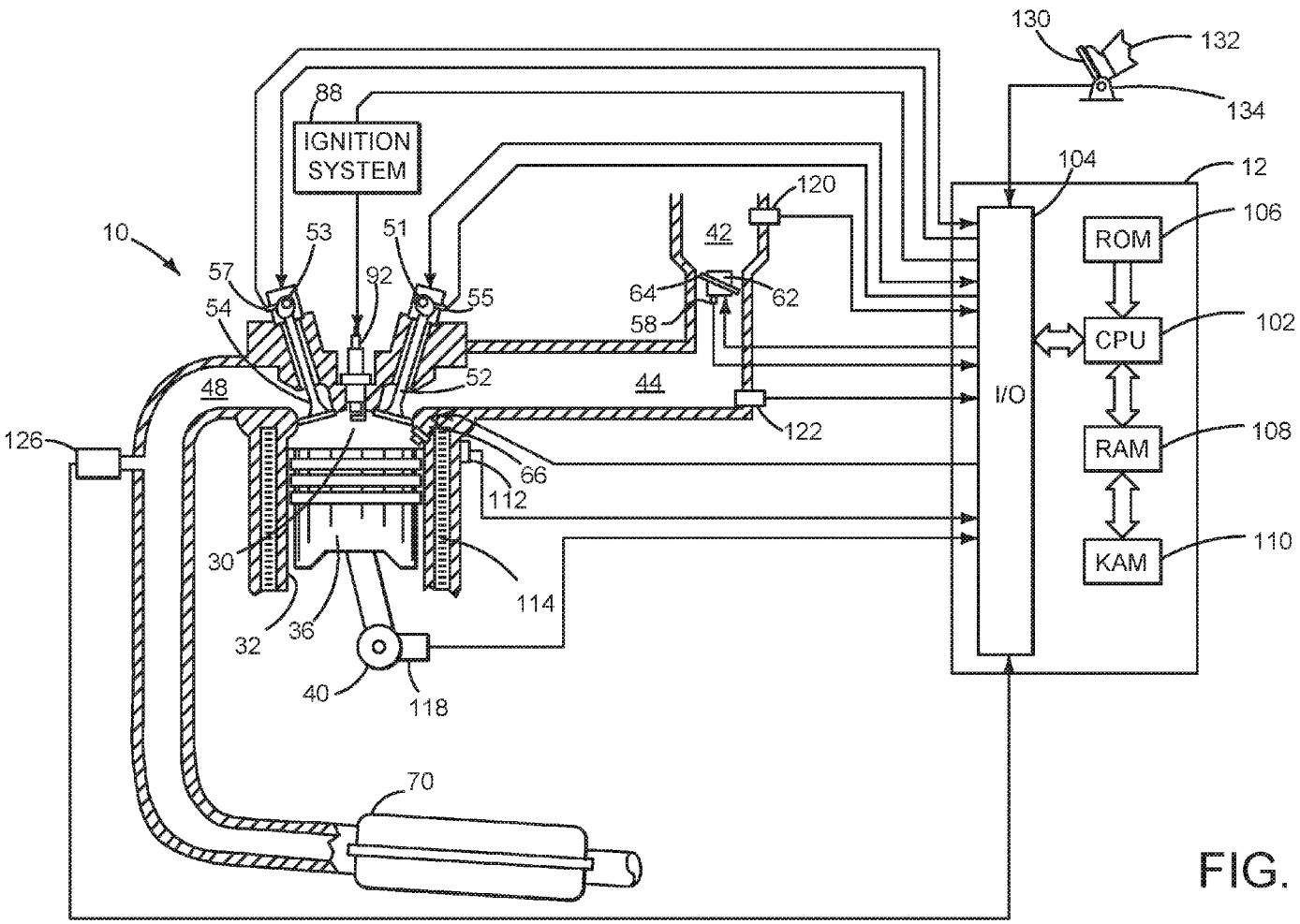
FIG. 1 is a schematic diagram of an engine.
Figure 2:
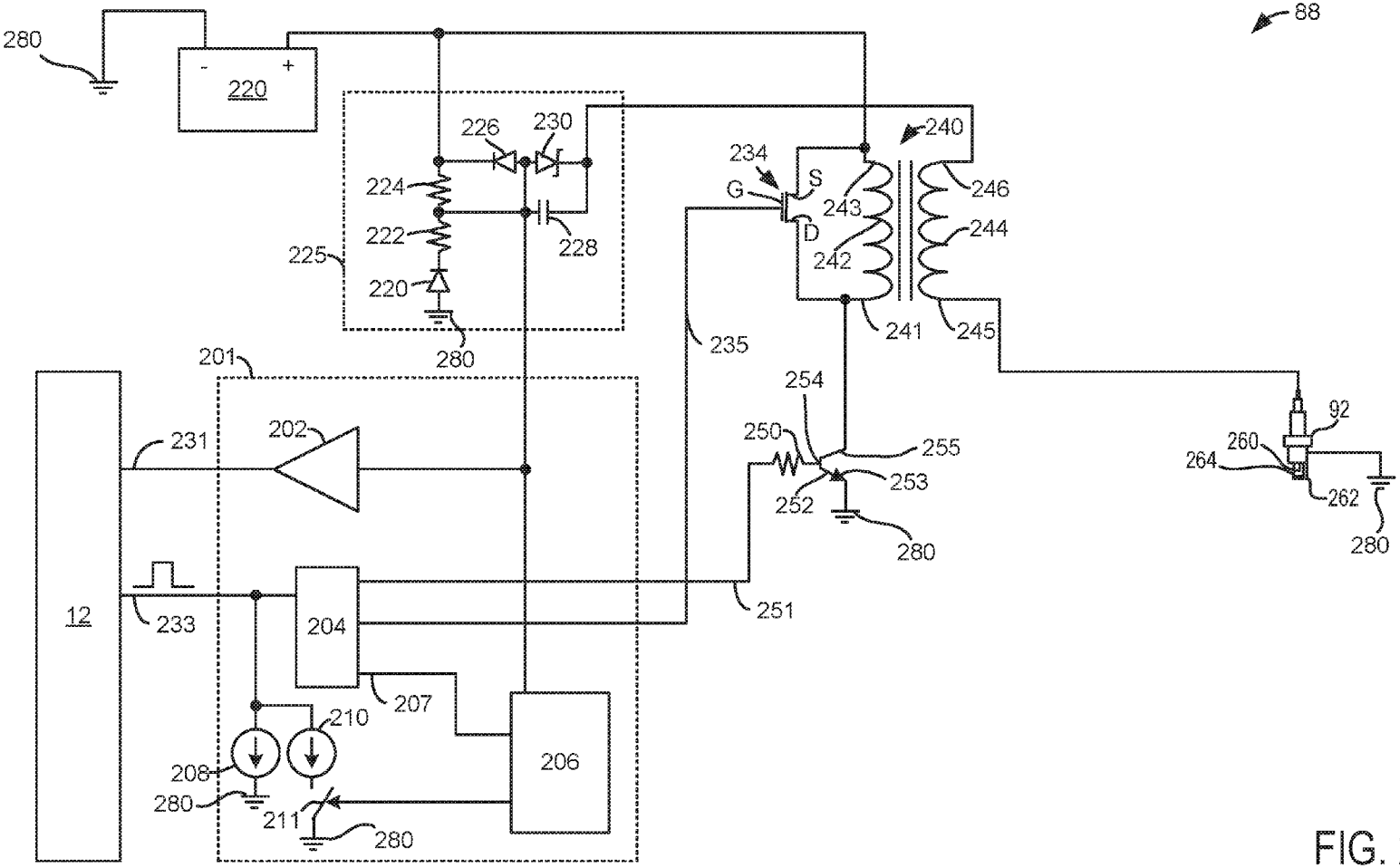
FIG. 2 is a schematic diagram of an ignition system.
Figure 3:
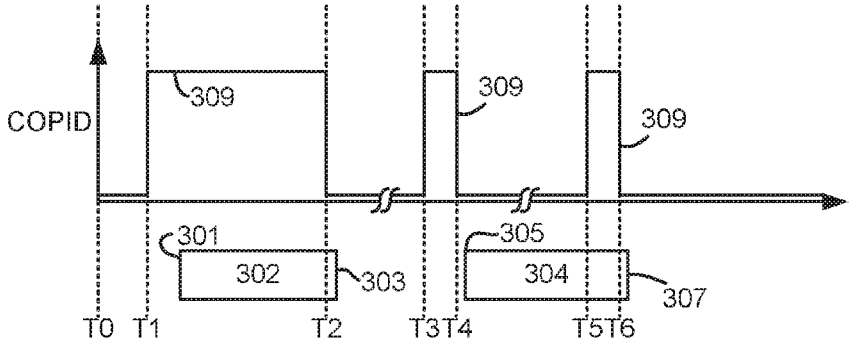
FIGS. 3-5 are example plots showing operation of the ignition system of FIG. 2 according to the method of FIG. 6.
Figure 4:
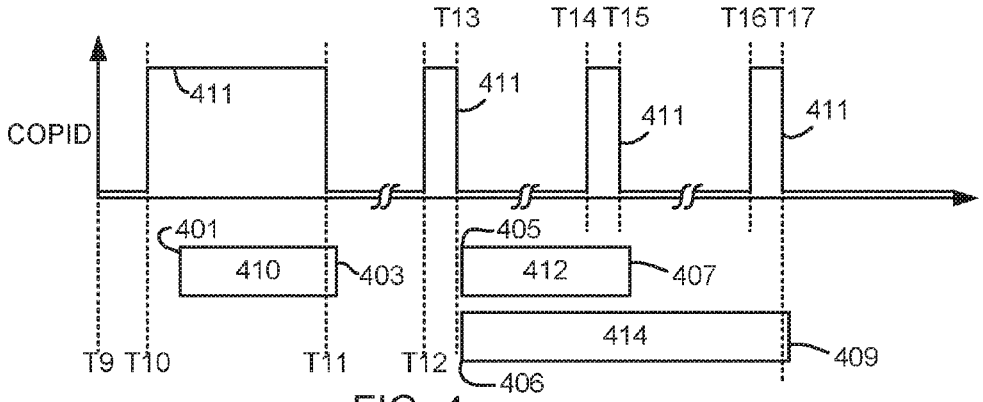
Figure 5:
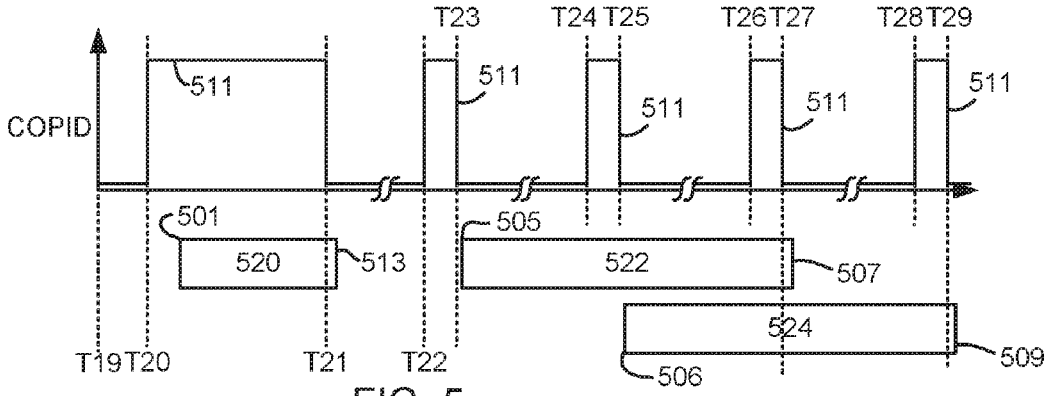
Figure 6:
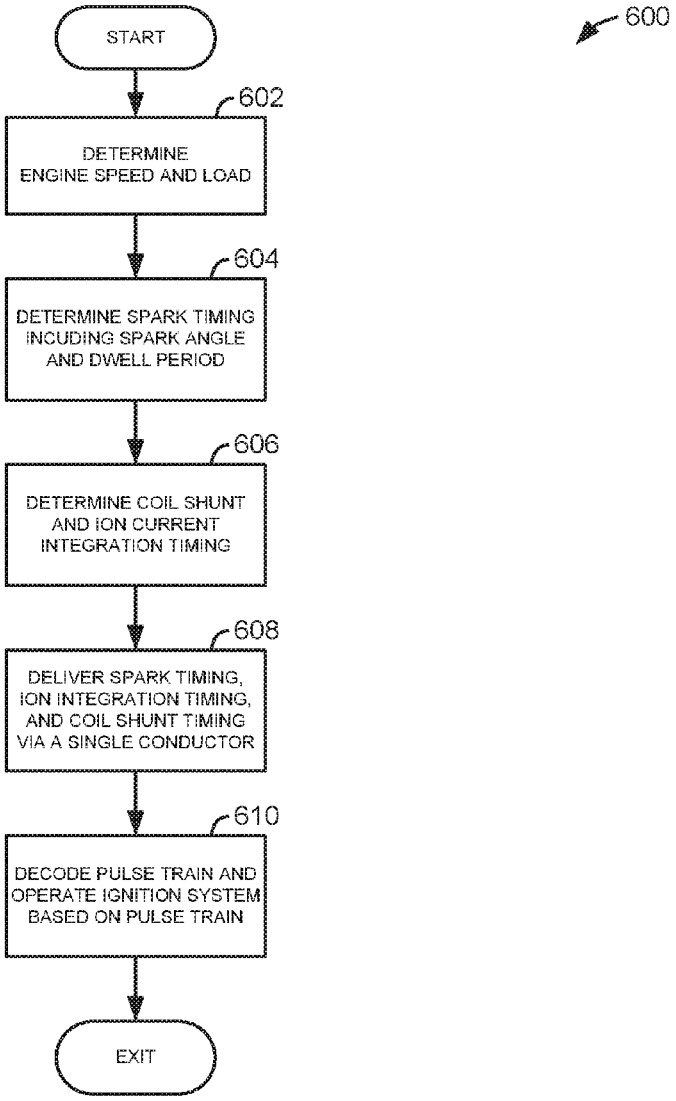
FIG. 6 shows a method for providing multiple ignition system commands from a controller to an ignition circuit via a single conductor.

The present description is related to operating an ignition system of a spark ignited engine. In one non-limiting example, a control signal comprising a plurality of voltage pulses during a cylinder cycle is supplied to an ignition coil module via a single wire. The ignition coil module may selectively charge and discharge an ignition coil in response to voltage pulses. Further, coil shunting and ion signal integration commands may be provided via voltage pulses over the same single wire or conductor. FIG. 1 shows an example engine and ignition system. FIG. 2 shows a detailed view of the ignition system shown in FIG. 1. Example ignition system control sequences are shown in FIGS. 3-5. A method for providing encoded ignition signals over the single wire is shown in FIG. 6.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of adjustable intake cam 51 may be determined by intake cam sensor 55. The position of adjustable exhaust cam 53 may be determined by exhaust cam sensor 57.

Fuel injector 66 is shown positioned to inject fuel directly into cylinder 30, which is known to those skilled in the art as direct injection. Alternatively, fuel may be injected to an intake port, which is known to those skilled in the art as port injection. Fuel injector 66 delivers liquid fuel in proportion to a pulse width of a signal from controller 12. Fuel is delivered to fuel injector 66 by a fuel system (not shown) including a fuel tank, fuel pump, and fuel rail (not shown). In addition, intake manifold 44 is shown communicating with optional electronic throttle 62 which adjusts a position of throttle plate 64 to control air flow from air intake 42 to intake manifold 44.

Distributorless ignition system 88 provides an ignition spark to combustion chamber 30 via spark plug 92 in response to commands from controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only (e.g., non-transitory) memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 58. Barometric pressure may also be sensed (sensor not shown) for processing by controller 12. In one aspect of the present description, engine position sensor 118 produces a predetermined number of equally spaced pulses every revolution of the crankshaft from which engine speed (RPM) can be determined.

In some examples, the engine may be coupled to an electric motor/battery system in a hybrid vehicle. The hybrid vehicle may have a parallel configuration, series configuration, or variation or combinations thereof. Further, in some examples, other engine configurations may be employed, for example the engine may be turbocharged or supercharged.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g., when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g., when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Referring now to FIG. 2, is a schematic of an example ignition system 88. In this example, controller 12 receives sensed ion data from separate and remote ignition circuitry 201 via conductor or wire 231. Controller 12 provides command voltage pulses to remote ignition circuitry 201 via single wire or conductor 233. In one example, ignition circuitry 201 may be incorporated with a coil that is fitted on top of a spark plug. The ignition system 88 also includes ion sensing circuitry 225 for evaluating whether or not engine 10 is experiencing spark knock or misfire. Ignition coil 240 provides electrical energy from battery 220 to selectively generate a spark at spark plug 92. Battery 220 is connected to ground 280.

Ignition circuitry 201 includes an ion signal amplifier 202 that increases a magnitude of an analog ion signal provided by ion sensing circuitry 225. The ion signal from ion sensing circuitry 225 is also provided to ion signal integrator circuit 206 which integrates an ion signal over an engine crankshaft duration or window to provide a basis for indicating combustion quality or misfire. Ion signal integrator circuit 206 integrates the ion signal for a duration based on short duration voltage pulses provided by the controller during a cylinder cycle (e.g., COPID pulses between time T12 and time T17 shown in FIG. 4). By proper selection of the integration period, the controller is able to differentiate between normal and late combustion timing. Late combustion occurs after the integration period. The integrated value is an indication of combustion quality and the integrated value is reported back to the controller via opening switch 211. Switch 211 increases current flow in conductor 233 to provide a high current consumption state by activating current source 210 when switch 211 is closed. Current source 208 provides a low current consumption state when switch 211 is open. At the start of the dwell period, switch 211 is closed and the current is at a high level. During dwell a second integrator in circuit 206 integrates at a constant rate. When both integrated values are equal, switch 211 opens and the current goes to a lower level. The controller determines the integration value by measuring the time from the start of dwell to the time current is switched to a lower value.

Ignition circuitry 201 also includes voltage pulse decoder circuitry 204 that produces three output signals from voltage pulses carried by conductor 233. In particular, voltage decoder circuitry 204 includes combinational logic to provide a dwell signal for charging and discharging ignition coil 240. Voltage decoder circuitry 204 also includes combinational logic to provide an ignition coil shunt signal and an ion signal integration period signal. The voltage decoder circuitry 204 directs the dwell signal to insulated gate bipolar transistor (IGBT) 252 via resistor 250 and conductor 251. The voltage decoder circuitry 204 directs the ignition coil shunt signal to metal oxide field effect transistor (MOS- FET) 234 via conductor 235. The voltage decoder circuitry 204 directs the ion integration period signal to ion signal integrator circuit 206 via conductor 207.

Ignition coil 240 includes a primary winding 242 and a secondary winding 244. Primary winding 242 includes a first side 243 that is electrically coupled to battery 220 and a second side 241 that is electrically coupled to collector 255 of IGBT 252. MOSFET 234 is in electrical communication with first side 243 at source (S) and with second side 241 at drain (D). During shunting, current flows from 241 to 243. A low resistance electrical path is provided between drain (D) and source (S) of MOSFET 234 when a higher voltage (e.g., 5V higher than the MOSFET source (S)) is applied to gate (G) by decoder circuitry 204. A high resistance electrical path (e.g., open circuit) is provided between drain (D) and source (S) of MOSFET 234 when a lower voltage (e.g., 0V or ground) is applied to gate (G) by decoder circuitry 204. Consequently, a shunt may be provided between first side 243 and second side 241 by applying a higher voltage to gate (G). By shunting the primary winding 242, it may be possible to improve amplification of ion sensing so that engine knock detection and misfire detection may be improved even when secondary winding 244 has high inductance. A first side 246 of secondary winding 244 is electrically coupled to ion sensing circuitry 225. Ion sensing circuitry is electrically coupled to battery 220. A second side 245 of secondary winding 244 is electrically coupled to spark plug 92.

Spark plug 92 includes a first electrode 260 and a second electrode 262. An air gap 264 is provided between first electrode 260 and second electrode 262. Spark may develop in air gap 264 when IGBT is switched from on (e.g., closed switch) to off (e.g., open switch).

IGBT 252 includes an emitter 253, a base 254, and a collector 255. Current flow from decoder circuit 204 to IGBT 254 is limited via resistor 250. IGBT 252 is on (e.g., closed switch) when a higher voltage (e.g., 5 V) is applied to base 254 by decoder circuit 204. IGBT 252 is off (e.g., open switch) when a lower voltage (e.g., 0 V or ground) is applied to base 254 by decoder circuit 204. By closing IGBT 252, current from battery 220 flows through primary coil 242 to charge ignition coil 240. Opening IGBT 252 after primary coil 242 has charged may cause ignition coil 240 to discharge, thereby inducing spark at spark plug 96. In this way, spark may be provided to an engine cylinder via spark plug 92.

Ion sensing circuitry 225 is electrically coupled to first side 246 of secondary winding 244 and battery 220. Ion sensing circuitry 225 includes Zener diode 230, diode 226, diode 220, capacitor 228, resistor 222, and resistor 224. Output of ion sensing circuitry is a node between diode 226 and Zener diode 230. The ion circuit output is provided to ion amplifier 202 and ion integration circuit 206.

Thus, the ignition system 88 provides functionality to provide spark to a cylinder, sense ions, integrate an ion signal, and shunt an ignition coil to improve ion sensing. The ion sensing may provide an indication of engine knock and/or misfire. Commands for ion sensing and ignition control may be provided via a single conductor or wire that allows an engine controller to interface with ignition circuitry. Consequently, the circuitry may provide enhanced capability with no increase in electrical connections between the controller and the ignition circuitry.

The system of FIGS. 1 and 2 provides for supplying spark to an engine, comprising: a controller; an ignition circuit including a pulse decoding circuit and ion signal integration circuitry; a single conductor electrically coupling the controller and the ignition coil pre-driver circuit; an ignition coil including a primary coil; and an ignition coil shunting switch in electrical communication with the pulse decoding circuit. The system further comprises a controller including executable instructions stored in non-transitory memory to command spark timing, ignition coil shunting, and ion signal integration via the single conductor. The system includes executable instructions stored in non-transitory memory to output a voltage pulse for spark timing and a voltage pulse for ignition coil shunting. The system includes where the ignition coil shunting switch is electrically coupled to a first side of the primary coil and to a second side of the primary coil. The system further comprises a controller including executable instructions stored in non-transitory memory to provide a voltage pulse to command spark timing, a voltage pulse to command ignition coil shunting, and a voltage pulse to command ion signal integration. The system further comprises an ignition spark switch in electrical communication with the pulse decoding circuit.

Referring now to FIG. 3, a plot showing control signals for an ignition system providing spark to an engine cylinder during a cycle of an engine is shown. The plot shows an encoded signal COPID 309 for commanding and providing spark timing and ion signal integration and/or ignition coil shunt timing. COPID 309 is a coil on plug control signal for ignition timing and ion signal integration/coil shunt timing for one engine cylinder during a cycle of the cylinder. The spark timing and ion signal integration and/or ignition coil shunt timing is encoded in three voltage pulses. The COPID 309 signal is provided by the controller to the ignition circuitry.

The ignition dwell period (e.g., time the ignition coil is being charged) is shown relative to the COPID 309 signal at the timing of window 302. The ignition coil shunt timing window and/or ion integration window relative to the COPID 309 signal is shown at the timing of window 304. The vertical axis represents COPID signal level (e.g., voltage level) and the COPID signal is asserted at a higher level near the vertical axis arrow. The COPID signal is not asserted at a lower level near the horizontal axis. The horizontal axis represents time and time increases from the left side of FIG. 3 to the right side of FIG. 3. The double S markers along the horizontal axis represent breaks in time that may be long or short in duration.

At time T0, the COPID signal 309 is at a low level and not asserted. The ignition coil is not being charged and the ignition coil is not shunted nor is the ion signal being integrated. The engine cylinder is selected to receive spark based on the COPID signal 309 may have received spark during a previous cycle of the cylinder.

At time T1, the COPID signal 309 transitions to a high level to begin an ignition dwell command period where the ignition coil is commanded to charge. Shortly thereafter, the dwell timing period 302 begins where the ignition coil begins to charge in response to the ignition dwell command provided by the COPID signal 309 at time T1. In one example, there is a delay of 120 microseconds between the rising edge of COPID signal 309 at time T1 and the beginning of dwell time 302 at 301. The ion sensor output is not integrated nor is the ignition coil shunted at time T1.

At time T2, the COPID signal 309 transitions to a lower level to end the ignition dwell command period. The ending time at T2 may correspond to a particular engine crankshaft angle where spark ignition is desired (e.g., 20 degrees advanced of top dead center compression stroke for the cylinder receiving the spark). The dwell timing period 302 ends at 303 which may be 45 microseconds delayed from the falling edge of COPID signal 309 at time T2. The time duration between time T1 and time T2 is the dwell time (e.g., ignition coil charging time) and it may be in a range of between 1.5 and 2.5 milliseconds.

At time T3, signal 309 transitions to a higher level to provide information for ion integration and/or ignition coil shut timing. In some examples, ion integration and ignition coil shut timing may be provided based on a single window as shown at 304. In other examples, timing of window 304 may be the basis for only ion integration or only ignition coil shunting. The dwell voltage pulse between time T1 and T2 is complete by time T3. Ion integration and/or ignition coil shunting are not active at time T3.

At time T4, signal 309 transitions to a lower level to provide a short duration voltage pulse that identifies ion integration and/or ignition coil shunt timing information is being delivered to the ignition circuitry from the controller. In one example, ion integration and/or ignition coil shunt timing voltage pulses may be approximately 75 microseconds in duration to differentiate these voltage pulses from dwell timing voltage pulses. Shortly thereafter, the ion current integration and/or ignition coil shunting timing window 304 opens to begin ion current integration and/or ignition coil shunting. In one example, a time from T3 to opening of the ion current integration and/or ignition coil shunting window opening is 120 microseconds. This time allows for the ion integration and/or ignition coil shunt timing voltage pulse to complete before ion integration and/or ignition coil shunt begins.

At time T5, signal 309 transitions to a higher level to provide a short duration voltage pulse that identifies ion integration and/or ignition coil shunt timing information is being delivered to the ignition circuitry from the controller. The pulse duration between time T5 and time T6 is 75 microseconds in duration. This second ion integration and/or ignition coil shunt timing voltage pulse identifies the end timing of the ion integration period and/or ignition coil shunt timing. Shortly after time T6, the ion current integration and/or ignition coil shunt window 304 closes to cease ion current integration and/or ignition coil shunting. In one example, the ion current integration and/or ignition coil shunt window 304 closes 120 microseconds after the rising edge of the third voltage pulse at time T5.

In this way, ignition coil dwell time, spark time, ion current integration period and/or ignition coil shunt period or timing may be provided to ignition circuitry via three voltage pulses delivered over a single wire or conductor. The voltage pulses are provided by the controller and delivered to ignition circuitry. The timing of the three voltage pulses may be based on engine crankshaft angle. For example, time T2 may be a desired spark timing angle and the ion current integration and/or ignition shunt window may open at a first desired engine crankshaft angle and close at a second desired engine crankshaft angle.

Referring now to FIG. 4, a second plot showing control signals for an ignition system providing spark to an engine cylinder during a cycle of an engine is shown. The plot shows an encoded signal COPID 411 for providing spark timing and ion signal integration and/or ignition coil shunt timing. COPID 411 is a coil on plug control signal for ignition timing and ion signal integration/coil shunt timing for one engine cylinder during a cycle of the cylinder. The spark timing and ion signal integration and/or ignition coil shunt timing is encoded in four voltage pulses. The COPID 411 signal is provided by the controller to the ignition circuitry. In this example, the ion signal integration and/or ignition coil shut timing are provided in two differently timed windows 412 and 414. The ion signal integration timing window may be 412 and the ignition coil shunt timing window may be 414 or vise-versa.

The ignition dwell period (e.g., time the ignition coil is being charged) is shown relative to the COPID 411 signal at the timing of window 410. The first ignition coil shunt timing window and/or ion integration window relative to the COPID 411 signal is shown at the timing of window 412. The second ignition coil shunt timing window and/or ion integration window relative to the COPID 411 signal is shown at the timing of window 414. The first ignition coil shunt timing window and/or ion integration window 412 has a same starting timing as the second ignition coil shunt timing window and/or ion integration window 414. The vertical axis represents COPID signal level (e.g., voltage level) and the COPID signal is asserted at a higher level near the vertical axis arrow. The COPID signal is not asserted at a lower level near the horizontal axis. The horizontal axis represents time and time increases from the left side of FIG. 4 to the right side of FIG. 4. The double S markers along the horizontal axis represent breaks in time that may be long or short in duration.

At time T9, the COPID signal 411 is at a low level and not asserted. The ignition coil is not being charged and the ignition coil is not shunted nor is the ion signal being integrated. The engine cylinder selected to receive spark based on the COPID signal 411 may have received spark during a previous cycle of the cylinder.

At time T10, the COPID signal 411 transitions to a high level to begin an ignition dwell command period where the ignition coil is commanded to charge. Shortly thereafter, the dwell timing period 410 begins where the ignition coil begins to charge in response to the ignition dwell command provided by the COPID signal 411 at time T10. In one example, there is a delay of 120 microseconds between the rising edge of COPID signal 411 at time T10 and the beginning of dwell time 410 at 401. The ion sensor output is not integrated nor is the ignition coil shunted at time T10.

At time T11, the COPID signal 411 transitions to a lower level to end the ignition dwell command period. The ending time at T11 may correspond to a particular engine crankshaft angle where spark ignition is desired (e.g., 20 degrees advanced of top dead center compression stroke for the cylinder receiving the spark). The dwell timing period 410 ends at 403 which may be 45 micro-seconds delayed from the falling edge of COPID signal 411 at time T11. The time duration between time T10 and time T11 is the dwell time (e.g., ignition coil charging time) and it may be in a range of between 1.5 and 2.5 milliseconds.

At time T12, signal 411 transitions to a higher level to provide information for ion integration and/or ignition coil shut timing. In some examples, ion integration and ignition coil shut timing may be provided based on two windows as shown at 412 and 414. The timing of window 412 may be the basis for only ion integration or only ignition coil shunting. Likewise, the timing of window 414 may be the basis for only ion integration or only ignition coil shunting. The dwell voltage pulse between time T10 and T11 is complete by time T12. Ion integration and/or ignition coil shunting are not active at time T12.

At time T13, signal 411 transitions to a lower level to provide a short duration voltage pulse that identifies ion integration and/or ignition coil shunt timing information is being delivered to the ignition circuitry from the controller. In one example, ion integration and/or ignition coil shunt timing voltage pulses may be approximately 75 microseconds in duration to differentiate these voltage pulses from dwell timing voltage pulses. Shortly thereafter, the ion current integration and/or ignition coil shunting timing windows 412 and 414 open to begin ion current integration and ignition coil shunting. In one example, a time from T12 to opening of the ion current integration and/or ignition coil shunting windows opening is 120 microseconds. This time allows for the ion integration and/or ignition coil shunt timing voltage pulse to complete before ion integration and/or ignition coil shunt begins.

At time T14, signal 411 transitions to a higher level to provide a short duration voltage pulse that identifies ion integration and/or ignition coil shunt timing information is being delivered to the ignition circuitry from the controller. The pulse duration between time T14 and time T15 is 75 microseconds in duration. This second ion integration and/or ignition coil shunt timing voltage pulse identifies the end timing of the first ion integration period and/or ignition coil shunt timing window 412. Shortly after time T15, the ion current integration and/or ignition coil shunt window 412 closes to cease ion current integration and/or ignition coil shunting. In one example, the ion current integration and/or ignition coil shunt window 412 closes 120 microseconds after the rising edge of the third voltage pulse at time T14. The second ion integration period and/or ignition coil shunt timing window 414 remains open so that ion current integration or ignition coil shunting may continue.

At time T16, signal 411 transitions to a higher level to provide a short duration voltage pulse that identifies ion integration and/or ignition coil shunt timing information is being delivered to the ignition circuitry from the controller. The pulse duration between time T16 and time T17 is 75 microseconds in duration. This third ion integration and/or ignition coil shunt timing voltage pulse identifies the end timing of the second ion integration period and/or ignition coil shunt timing window 414. Shortly after time T17, the ion current integration and/or ignition coil shunt window 414 closes to cease ion current integration and/or ignition coil shunting. In one example, the ion current integration and/or ignition coil shunt window 414 closes 120 microseconds after the rising edge of the fourth voltage pulse at time T16. Thus, the first and second ion integration period and/or ignition coil shunt timing windows 412 and 414 are closed.

In this way, ignition coil dwell time, spark time, ion current integration period and/or ignition coil shunt period or timing may be provided to ignition circuitry via four voltage pulses delivered over a single wire or conductor. The voltage pulses are provided by the controller and delivered to ignition circuitry. The timing of the four voltage pulses may be based on engine crankshaft angle. For example, time T11 may be a desired spark timing angle and the ion current integration and/or ignition shunt window may open at a first desired engine crankshaft angle and close at a second desired engine crankshaft angle. The four voltage pulses allow for different ending times between window 412 and window 414 so that ignition coil shunting may be separated from ion current integration.

Referring now to FIG. 5, a third plot showing control signals for an ignition system providing spark to an engine cylinder during a cycle of an engine is shown. The plot shows an encoded signal COPID 511 for providing spark timing and ion signal integration and/or ignition coil shunt timing. COPID 511 is a coil on plug control signal for ignition timing and ion signal integration/coil shunt timing for one engine cylinder during a cycle of the cylinder. The spark timing and ion signal integration and/or ignition coil shunt timing is encoded in five voltage pulses. The COPID 511 signal is provided by the controller to the ignition circuitry. In this example, the ion signal integration and/or ignition coil shut timing are provided in two differently timed windows 522 and 524. The timing windows 522 and 524 have different start and stop times. The ion signal integration timing window may be 522 and the ignition coil shunt timing window may be 524 or vise-versa.

The ignition dwell period (e.g., time the ignition coil is being charged) is shown relative to the COPID 511 signal at the timing of window 520. The first ignition coil shunt timing window and/or ion integration window relative to the COPID 511 signal is shown at the timing of window 522. The second ignition coil shunt timing window and/or ion integration window relative to the COPID 511 signal is shown at the timing of window 524. The first ignition coil shunt timing window and/or ion integration window 522 has a different starting and ending timing than the second ignition coil shunt timing window and/or ion integration window 524. The vertical axis represents COPID signal level (e.g., voltage level) and the COPID signal is asserted at a higher level near the vertical axis arrow. The COPID signal is not asserted at a lower level near the horizontal axis. The horizontal axis represents time and time increases from the left side of FIG. 54 to the right side of FIG. 5. The double S markers along the horizontal axis represent breaks in time that may be long or short in duration.

At time T19, the COPID signal 511 is at a low level and not asserted. The ignition coil is not being charged and the ignition coil is not shunted nor is the ion signal being integrated. The engine cylinder selected to receive spark based on the COPID signal 511 may have received spark during a previous cycle of the cylinder.

At time T20, the COPID signal 511 transitions to a high level to begin an ignition dwell command period where the ignition coil is commanded to charge. Shortly thereafter, the dwell timing period 520 begins where the ignition coil begins to charge in response to the ignition dwell command provided by the COPID signal 511 at time T20. In one example, there is a delay of 120 microseconds between the rising edge of COPID signal 511 at time T20 and the beginning of dwell time 520 at 501. The ion sensor output is not integrated nor is the ignition coil shunted at time T20.

At time T21, the COPID signal 511 transitions to a lower level to end the ignition dwell command period. The ending time at T21 may correspond to a particular engine crankshaft angle where spark ignition is desired (e.g., 20 degrees advanced of top dead center compression stroke for the cylinder receiving the spark). The dwell timing period 520 ends at 513 which may be 45 micro-seconds delayed from the falling edge of COPID signal 511 at time T21. The time duration between time T20 and time T21 is the dwell time (e.g., ignition coil charging time) and it may be in a range of between 1.5 and 2.5 milliseconds.

At time T22, signal 511 transitions to a higher level to provide information for ion integration and/or ignition coil shut timing. In some examples, ion integration and ignition coil shut timing may be provided based on two windows as shown at 522 and 524. The timing of window 522 may be the basis for only ion integration or only ignition coil shunting. Likewise, the timing of window 524 may be the basis for only ion integration or only ignition coil shunting. The dwell voltage pulse between time T20 and T21 is complete by time T22. Ion integration and/or ignition coil shunting are not active at time T22.

At time T23, signal 511 transitions to a lower level to provide a short duration voltage pulse that identifies ion integration and/or ignition coil shunt timing information is being delivered to the ignition circuitry from the controller.

In one example, ion integration and/or ignition coil shunt timing voltage pulses may be approximately 75 microseconds in duration to differentiate these voltage pulses from dwell timing voltage pulses. Shortly thereafter, the ion current integration and/or ignition coil shunting timing window 522 open to begin ion current integration and/or ignition coil shunting. In one example, a time from T22 to opening of the ion current integration and/or ignition coil shunting windows opening is 120 microseconds. This time allows for the ion integration and/or ignition coil shunt timing voltage pulse to complete before ion integration and/or ignition coil shunt begins.

At time T24, signal 511 transitions to a higher level to provide a short duration voltage pulse that identifies ion integration and/or ignition coil shunt timing information is being delivered to the ignition circuitry from the controller. The pulse duration between time T24 and time T25 is 75 microseconds in duration. This second ion integration and/or ignition coil shunt timing voltage pulse identifies the start timing of the second ion integration period and/or ignition coil shunt timing window 524. Shortly after time T25, the ion current integration and/or ignition coil shunt window 524 opens to begin ion current integration and/or ignition coil shunting. In one example, the ion current integration and/or ignition coil shunt window 524 opens 120 microseconds after the rising edge of the third voltage pulse at time T24. The first ion integration period and/or ignition coil shunt timing window 522 remains open so that ion current integration or ignition coil shunting may continue.

At time T26, signal 511 transitions to a higher level to provide a short duration voltage pulse that identifies ion integration and/or ignition coil shunt timing information is being delivered to the ignition circuitry from the controller. The pulse duration between time T26 and time T27 is 75 microseconds in duration. This fourth ion integration and/or ignition coil shunt timing voltage pulse identifies the end timing of the first ion integration period and/or ignition coil shunt timing window 522. Shortly after time T27, the ion current integration and/or ignition coil shunt window 522 closes to cease ion current integration and/or ignition coil shunting. In one example, the ion current integration and/or ignition coil shunt window 522 closes 120 microseconds after the rising edge of the fourth voltage pulse at time T26. Thus, the first ion integration period and/or ignition coil shunt timing windows 522 is closed.

At time T28, signal 511 transitions to a higher level to provide a short duration voltage pulse that identifies ion integration and/or ignition coil shunt timing information is being delivered to the ignition circuitry from the controller. The pulse duration between time T28 and time T29 is 75 microseconds in duration. This fifth ion integration and/or ignition coil shunt timing voltage pulse identifies the end timing of the second ion integration period and/or ignition coil shunt timing window 524. Shortly after time T29, the ion current integration and/or ignition coil shunt window 524 closes to cease ion current integration and/or ignition coil shunting. In one example, the ion current integration and/or ignition coil shunt window 524 closes 120 microseconds after the rising edge of the fifth voltage pulse at time T28. Thus, the second ion integration period and/or ignition coil shunt timing windows 524 is closed.

In this way, ignition coil dwell time, spark time, ion current integration period and/or ignition coil shunt period or timing may be provided to ignition circuitry via five voltage pulses delivered over a single wire or conductor. The voltage pulses are provided by the controller and delivered to ignition circuitry. The timing of the five voltage pulses may be based on engine crankshaft angle. For example, time T21 may be a desired spark timing angle and the ion current integration and/or ignition shunt windows may open at first and second desired engine crankshaft angles and close at different desired engine crankshaft angles. The five voltage pulses allow for different starting and ending times between window 522 and window 524 so that ignition coil shunting may be separated from ion current integration.

Referring now to FIG. 6, a method for encoding spark timing, ion signal integration, and ignition coil primary winding shunting via a single conductor or wire is described. The ignition system may be similar to the ignition system shown in FIG. 2. Additionally, at least portions of the method of FIG. 6 may be included as executable instructions in the system of FIGS. 1 and 2. Further, at least portions of the method of FIG. 6 may be actions taken in cooperation with a controller and an ignition system in the physical world to transform ignition operation. The method of FIG. 6 may be applied to ignition coils of all engine cylinders. The description of first, second, and third voltage pulse widths used in the method of FIG. 6 apply to voltage pulse widths that are present if the ignition system is operating without degradation.

At 602, method 600 determines engine speed and load. Engine speed may be determined via an engine position sensor output and engine load may be determined via output of a manifold pressure sensor or a mass air flow sensor that senses air flow through the engine. Method 600 proceeds to 604 after determining engine speed and load.

At 604, method 600 determines cylinder spark timing and dwell period. In one example, method 600 indexes a table of empirically determined spark angles and a table of ignition coil dwell times based on engine speed and engine load as determined at 602 and measured battery voltage. The tables output a spark angle relative to top-dead-center compression stroke for the cylinder receiving the spark and a dwell time that is based on ignition coil construction and engine operating conditions. For example, a spark angle of −10 crankshaft degrees (e.g., 10 crankshaft degrees before top dead center compression stroke of the cylinder receiving the spark) may be output from the table and a dwell time of 2 milliseconds. Method 600 proceeds to 606 after spark angle and dwell time are determined.

At 606, method 600 determines ignition coil primary coil shunt timing and ion signal integration timing. In one example, method 600 indexes a table that outputs an engine crankshaft angle where ignition coil primary coil shunting is to begin for a cylinder cycle. Further, method 600 indexes a second table that outputs an engine crankshaft angle where ignition coil primary coil shunting is to end for a cylinder cycle. Method 600 also indexes a table that outputs an engine crankshaft angle where ion signal integration is to begin for a cylinder cycle. Method 600 also indexes a second table that outputs an engine crankshaft angle where ion signal integration is to end for a cylinder cycle.

The window (e.g., crankshaft timing and duration for ion signal integration) of ion signal integration may be later in time than the spark angle determined at 604 so that misfire may be detected more accurately. For example, spark timing may be 30 crankshaft degrees before top-dead-center compression stroke and ion signal integration may begin at 10 crankshaft degrees before top-dead-center compression stroke. The ion signal integration window may allow ion signal integration for 90 crankshaft degrees from the starting timing of 10 crankshaft degrees before top-dead-center compression stroke.

Likewise, the window (e.g., crankshaft timing and duration for ignition coil primary winding shunting) of ignition coil primary winding shunting may be later in time than the spark angle determined at 604. Further, the ignition coil primary winding shunting may begin at the same time as ion signal integration. Alternatively, the ignition coil primary winding shunting may begin at the before or after timing of ion signal integration. Thus, the ion signal integration window and the ignition coil shunting window may be at the timings described in FIGS. 3-5. Method 600 proceeds to 608.

At 608, method 600 delivers the requested spark timing, ion signal integration, and ignition primary winding shunting commands to the ignition system via a single conductor or wire. The spark timing for a cylinder is provided via a first voltage pulse on the wire during an engine cycle. The end of the first voltage pulse is provided at a crankshaft angle where spark is desired plus a delay time (e.g., 45 microseconds). The beginning of the first voltage pulse is the dwell time determined at 604 and added to the spark angle of desired spark and the delay time. For example, if the desired ignition timing is 30 crankshaft degrees before top-dead-center compression stroke and the dwell time is 2 milliseconds, the COPID signal transitions to a high level 2 milliseconds plus the first delay period and a second delay period (e.g., 120 microseconds) before the engine reaches 30 crankshaft degrees before top-dead-center compression stroke for the cylinder receiving the spark. In this way, the ignition circuit may be commanded a dwell time and a spark angle or time via a single voltage pulse.

Method 600 then evaluates the ion signal integration window timing and the ignition coil primary shunt window timing. If the ion signal integration window and the ignition coil primary shunt window have same opening times (e.g., 301) and closing times (e.g., 303) as shown in FIG. 3, method 600 outputs two short duration voltage pulses after the dwell voltage pulse is output. The first of two voltage pulse (e.g., the second voltage pulse in the cylinder cycle) is output in a cylinder cycle after the ignition dwell pulse (e.g., the first voltage pulse output during the cylinder cycle). The first of two voltage pulses identifying start of ignition primary coil shunting and/or ion signal integration timing as is described in FIG. 3 is output to the ignition circuitry. The second of two voltage pulses identifying end of ignition primary coil shunting and/or ion signal integration timing as is described in FIG. 3 is output to the ignition circuitry. The two pulses are output during the cylinder cycle after the spark timing dwell pulse as is shown in FIG. 3. Similar dwell and ignition primary coil shunting and/or ion signal integration timing voltage pulses may be output during subsequent cylinder cycles.

If the ion signal integration window and the ignition coil primary shunt window have same opening times (e.g., 405 and 406) and different closing times (e.g., 407 and 409) as shown in FIG. 4, method 600 outputs three short duration voltage pulses after the dwell voltage pulse. The first of three short duration voltage pulse (e.g., the second voltage pulse in the cylinder cycle) is output in a cylinder cycle after the ignition dwell pulse (e.g., the first voltage pulse output during the cylinder cycle). The first of three short duration voltage pulses identifying start of ignition primary coil shunting and/or ion signal integration timing as described in FIG. 4 is output to the ignition circuitry. The second of three short duration voltage pulses identifying end of one ignition primary coil shunting and/or ion signal integration timing as described in FIG. 4 is output to the ignition circuitry. The third of three short duration voltage pulses identifying end of a second ignition primary coil shunting and/or ion signal integration timing as described in FIG. 4 is output to the ignition circuitry. The three pulses are output during the cylinder cycle after the spark timing dwell pulse as is shown in FIG. 4 to provide a total of four voltage pulses during a cylinder cycle. Similar dwell and ignition primary coil shunting and/or ion signal integration timing voltage pulses may be output during subsequent cylinder cycles.

If the ion signal integration window and the ignition coil primary shunt window have different opening times (e.g., 505 and 506) and different closing times (e.g., 507 and 509) as shown in FIG. 5, method 600 outputs four short duration voltage pulses after the dwell voltage pulse. The first of four short duration voltage pulses (e.g., the second voltage pulse in the cylinder cycle) is output in a cylinder cycle after the ignition dwell pulse (e.g., the first voltage pulse output during the cylinder cycle). The first of four short duration voltage pulses identifying a first start of ignition primary coil shunting and/or ion signal integration timing as described in FIG. 5 is output to the ignition circuitry. The second of four short duration voltage pulses identifying start of a second ignition primary coil shunting and/or ion signal integration timing as described in FIG. 5 is output to the ignition circuitry. The third of four short voltage pulses identifying end of a first ignition primary coil shunting and/or ion signal integration timing as described in FIG. 5 is output to the ignition circuitry. The fourth of four short voltage pulses identifying end of a second ignition primary coil shunting and/or ion signal integration timing as described in FIG. 5 is output to the ignition circuitry. The four short duration pulses are output during the cylinder cycle after the spark timing dwell pulse as shown in FIG. 5. Similar dwell and ignition primary coil shunting and/or ion signal integration timing voltage pulses may be output during subsequent cylinder cycles.

The dwell voltage pulse and the ignition primary coil shunting and/or ion signal integration timing voltage pulse are output from the controller to the ignition circuit via a single conductor or wire. A new voltage pulse train is provided each cylinder cycle, and the pulse train reflects changes in engine operation. Method 600 proceeds to 610.

At 610, method 600 decodes the dwell voltage pulse and the ignition primary coil shunting and/or ion signal integration timing voltage pulses. In one example, the dwell voltage pulse is converted into a voltage pulse that is applied to an IGBT to charge and discharge the ignition coil. The ignition primary coil shunting and/or ion signal integration timing voltage pulses are converted into an ignition coil shunt voltage pulse that is applied to a shunt switch (e.g., 234 of FIG. 2). Further, the ignition primary coil shunting and/or ion signal integration timing voltage pulses are converted into an ion signal integration voltage pulse that is applied to an ion signal integrator. The ion signal integrator outputs a value of integrating an ion signal during opening of an ion signal integrator window to the controller. Method 600 proceeds to exit after the pulse train provided to the controller is decoded and the ignition system is operated according to the pulse train.

In this way, the method of FIG. 6 provides for different numbers of short duration voltage pulses to indicate desired ion signal integration timing and ignition coil primary winding shunting. The short duration voltage pulses are provided during a single cylinder cycle after a dwell pulse that indicates ignition coil charging time and spark timing or angle.

Thus, the method of FIG. 6 provides for a method for providing spark to an engine, comprising: receiving input from one or more engine sensors to a controller; and commanding via the controller shunting, integrating, charging, and discharging of an ignition coil during a cylinder cycle in response to the input, the commanding accomplished via a single conductor providing electrical communication between the controller and an ignition coil drive circuit.

The method includes where the charging and discharging of the ignition coil is commanded via a dwell pulse over the single conductor. The method includes where the shunting provides a low resistance electrical path between a first side of a primary coil of an ignition coil and a second side of the primary ignition coil.

In some examples, the method includes where the shunting is performed during an engine crankshaft interval where engine knock is expected (e.g., from TDC to 90 crankshaft degrees after TDC of the cylinder receiving spark). The method includes where the one or more engine sensors includes an engine crankshaft position sensor. The method includes where the ignition coil drive circuit includes a pulse decoder circuit. The method includes where the commanding is provided via one or more voltage pulses over the single conductor. The method includes where shunting (e.g., providing a low resistance current path between two sides of a primary ignition coil) includes closing a switch between a first side of a primary coil of an ignition coil and a second side of the primary ignition coil.

The method of FIG. 6 also provides for a method for providing spark to an engine, comprising: receiving input from one or more engine sensors to a controller; and commanding via the controller shunting, integrating, charging, and discharging of an ignition coil during a cylinder cycle in response to the input, the commanding accomplished via a single conductor providing electrical communication between the controller and an ignition coil drive circuit and three or more voltage pulses.

In some examples, the method further comprises commanding via the controller an ion signal integration timing, where the ion signal integration timing is shortened so as to not integrate an entire late combustion ion wave form during the cylinder cycle, where a third voltage pulse of the at least three or more voltage pulses is a voltage pulse for starting or ending ignition coil shunting or a voltage pulse for starting or ending ion signal integration. and where a fourth voltage pulse of the at least three or more voltage pulses is a voltage pulse for staring ignition coil shunting or ion signal integration. The method includes where the shunting and ion signal integration timing is later in time than a pulse representing ignition timing dwell, where a third voltage pulse of the at least three or more voltage pulses is a voltage pulse for starting ignition coil shunting or ion signal integration. The method includes where a first voltage pulse of the three or more voltage pulses is an ignition timing dwell pulse, and where a third voltage pulse of the three or more voltage pulses is a pulse for ending ignition coil shunting or ion signal integration.

The method also includes where a second voltage pulse of the three or more voltage pulses is a pulse for start of ignition coil shunting, ion signal integration, or both ignition coil shunting and ion signal integration, where a third voltage pulse of the three or more voltage pulses is a pulse for ending ignition coil shunting, ion signal integration or ending both ignition coil shunting and ion signal integration, where a fourth voltage pulse of the three or more voltage pulses is a pulse for ending ignition coil shunting and ending ion signal integration or ending both ignition coil shunting and ion signal integration, where a fifth voltage pulse of the three or more voltage pulses is a pulse for ending ignition coil shunting or ion signal integration. The method also includes where the three or more voltage pulses include a pulse for an ignition dwell, a pulse shorter than the pulse for the ignition dwell for start of primary ignition coil shunting, a pulse shorter than the pulse for the ignition dwell for start of ion signal integration, a pulse shorter than the pulse for the ignition dwell for end of primary ignition coil shunting primary ignition coil shunting, and a pulse shorter than the pulse for the ignition dwell for end of ion signal integration.

Figure 7:
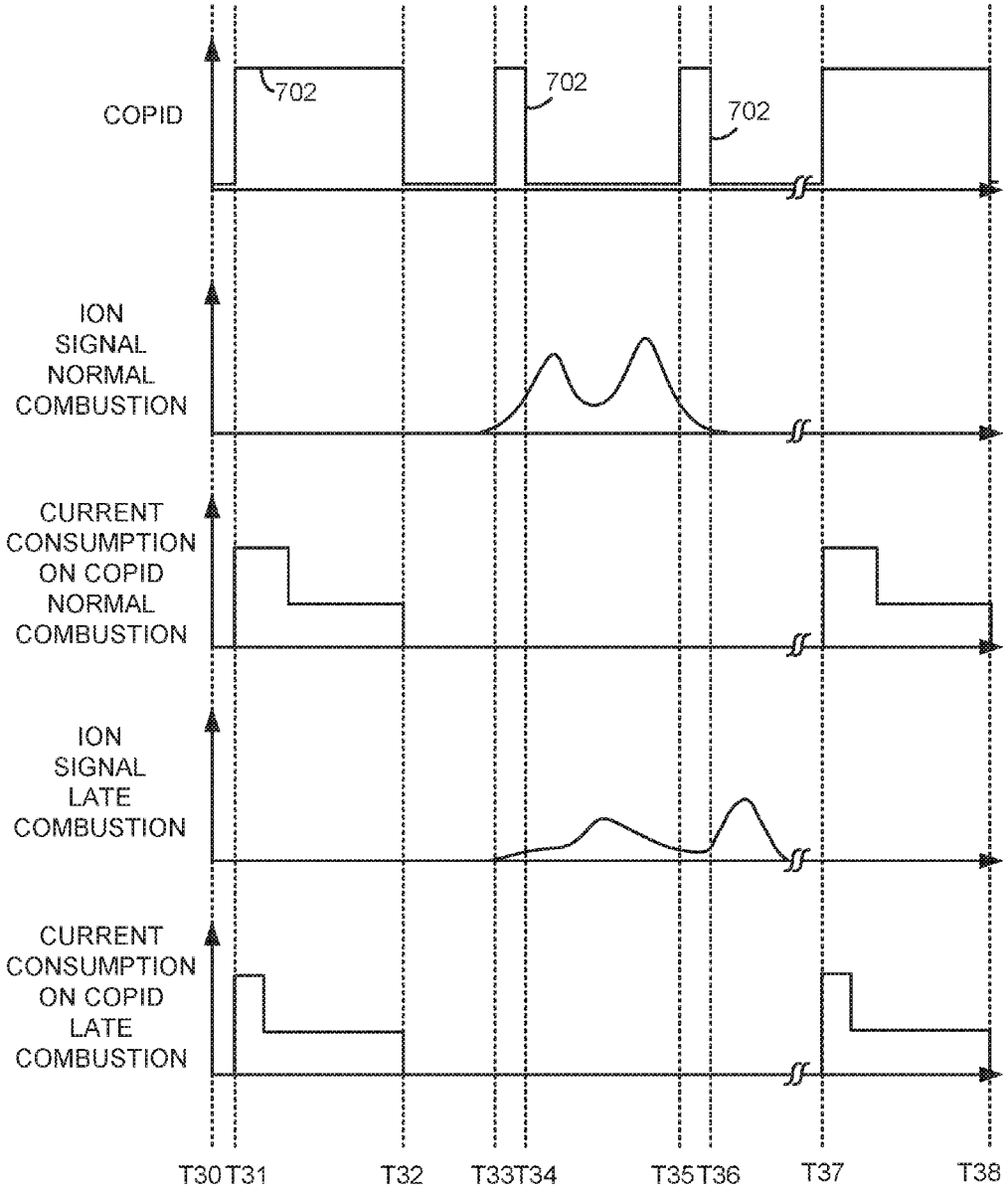
FIG. 7 shows a plot of ignition system commands and ion signal integration for normal and late combustion.

Referring now to FIG. 7, plots of ignition system commands and ion signal integration for normal and late combustion for a cylinder cycle are shown. The plots show an encoded signal COPID 702 for commanding and providing spark timing and ion signal integration. COPID 702 is a coil on plug control signal for ignition timing and ion signal integration timing for one engine cylinder during a cycle of the cylinder. The spark timing and ion signal integration timing is encoded in three voltage pulses. The COPID 702 signal is provided by the controller to the ignition circuitry. The signals shown in FIG. 7 may be provided by the system of FIGS. 1 and 2 according to the method of FIG. 6. FIG. 7 shows a contrast in ion signals for normal and late combustion. The timing of voltage pulses for integrating the ion signal is based on crankshaft angle durations for expected burn rates of the air-fuel mixture in the cylinder based on engine speed and load.

The first plot from the top of FIG. 7 is a plot of COPID versus time. The vertical axis represents COPID voltage and the horizontal axis represents time. COPID voltage increases in the direction of the vertical axis arrow. Time increases from the left side of FIG. 7 to the right side of FIG. 7.

The second plot from the top of FIG. 7 is a plot of ion signal for normal combustion versus time. The vertical axis represents ion signal voltage for normal combustion and the horizontal axis represents time. Ion signal voltage for normal combustion increases in the direction of the vertical axis arrow. Time increases from the left side of FIG. 7 to the right side of FIG. 7.

The third plot from the top of FIG. 7 is a plot of current consumption on the COPID signal representing the integrated ion signal for normal combustion versus time. The vertical axis represents current consumption on COPID and shows two non-zero values during dwell. The horizontal axis represents time and time increases from the left to the right side of the plot. The integrated ion signal for normal combustion is represented by the time from the beginning of dwell (e.g., rising edge of dwell voltage pulse) to the high to low current level switch.

The fourth plot from the top of FIG. 7 is a plot of ion signal for late combustion versus time. The vertical axis represents ion signal voltage for normal combustion and the horizontal axis represents time. Ion signal voltage for late combustion increases in the direction of the vertical axis arrow. Time increases from the left side of FIG. 7 to the right side of FIG. 7.

The fifth plot from the top of FIG. 7 is a plot of current consumption on the COPID signal representing the integrated ion signal for late combustion versus time. The vertical axis represents current consumption on the COPID signal and it shows two non-zero values during dwell. The horizontal axis represents time. Time increases from the left side of FIG. 7 to the right side of FIG. 7. The integrated ion signal for late combustion is represented by the time from the beginning of dwell to the high to low level current switch.

At time T30, the COPID signal is at a lower level and ignition timing signals for a previous cylinder cycle have ended. The ion signals for normal and late combustion are zero (e.g., the ion signal level of the horizontal axis) as are the current consumption values on COPID for normal and late combustion.

At time T31, the controller outputs a rising edge of a dwell voltage pulse for the cylinder in which spark is commanded. The dwell time between time T31 and T32 defines the amount of energy stored in an ignition coil. The ion signals for normal and late combustion are zero (e.g., the ion signal level of the horizontal axis). The current consumption values on COPID both go to the high level.

At some time prior to T32 the current consumption values on COPID both go to their lower levels when switch 211 opens. The time from the start of dwell T31 to this switch point indicates the integrated ion signal value for the previous combustion event.

At time T32, the controller outputs a falling edge of the voltage pulse ending the dwell period and beginning the coil discharge that produces spark in the cylinder. The ion signals for normal and late combustion are zero (e.g., the ion signal level of the horizontal axis), as are the COPID current consumption values for normal and late combustion. Stored integration values from the previous combustion event are reset to zero.

At time T33, the controller outputs a rising edge of a voltage pulse which indicates a beginning of the ion signal integration period will soon follow. The ion signals for normal and late combustion can be non-zero (e.g., the ion signal level above the horizontal axis) but any signal content will not be integrated. The COPID current consumption values for normal and late combustion remain at zero. In this example, the first voltage pulse after the dwell voltage pulse in the cylinder cycle is output at a timing soon after the ion signal for normal combustion and the ion signal for late combustion begin to increase.

At time T34, the controller outputs a falling edge of a voltage pulse that indicates the beginning of the ion signal integration period. The ion signals for normal and late combustion continue to increase and integration of the ion signal begins.

Between time T34 and time T35, the ion signal for normal combustion increases and decreases twice; however, not all ion signals will follow the trajectory shown. The first peak occurs soon after time T34 and a second peak occurs before time T35. The ion signal for late combustion increases once and decreases once between time T34 and time T35. Further, the magnitude of the ion signal for late combustion is reduced because of late combustion. The engine crankshaft angular window is adjusted to integrate in a crankshaft range where a predetermined portion (e.g., greater than 75%) of the ion signal for normal combustion is expected to occur. The engine crankshaft angular window begins and ends before a predetermined portion (e.g., less than 75%) of an ion signal for late combustion is expected to occur. As a result, the integrator integrates a larger portion of an ion signal for normal combustion as compared to a portion of the ion signal for late combustion.

At time T35, the controller outputs a rising edge of a voltage pulse that indicates the ending of the ion signal integration period is soon to follow. In this example, the ion signal for normal combustion continues to decrease and the ion signal for late combustion is also decreasing, but for other examples this may not be the case.

At time T36, the controller outputs a falling edge of a voltage pulse that indicates the end of the ion signal integration period. The falling edge of the third voltage pulse occurs before the end of the ion signal content for late combustion. In this way, integration of the ion signal for late combustion is cut-off so that the integrated ion signal for late combustion is less than the ion signal for normal combustion.

Between time T36 and time T37, the ion signal for late combustion increases, but since the ion signal integration period has ended, the integrated ion signal for late combustion does not increase. Thus, the timing of the voltage pulses at times T33 and T35 allows the ion signal from normal combustion to integrate both ion signal peaks while only allowing integration of one peak of the ion signal for late combustion in this example. The lower integrated ion signal for late combustion may be a basis for determining undesirable combustion.

At time T37, the cylinder cycle is over and a new dwell pulse is output for a subsequent cylinder cycle. COPID current consumption goes to the higher level. At some time prior to the end of dwell T38, COPID current consumption will switch to the lower level, the switch point occurring earlier for the late combustion cycle. In this manner, the integrator values are communicated back to the controller. At time T38, dwell ends, spark occurs and the integrators are reset to zero before integration begins for this subsequent cylinder cycle.

Thus, the ion signal integration period between T34 and T36 may be used to distinguish normal combustion from late combustion. In particular, if the integrated ion signal is less than a threshold value, but is larger than the misfire case, it may be determined that late combustion is occurring. The timing between T34 and T36 may be shortened to a predetermined engine crank angle duration to improve the detection of late combustion. Likewise, the timing between T34 and T36 may be increased to integrate a greater portion of an ion signal for late combustion.

As will be appreciated by one of ordinary skill in the art, routines described in FIG. 6 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but it is provided for ease of illustration and description. The methods and sequences described herein may be provided via executable instructions stored in non-transitory memory of a control in the system or systems described herein. Although not explicitly illustrated, one of ordinary skill in the art will recognize that one or more of the illustrated steps or functions may be repeatedly performed depending on the particular strategy being used.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, or alternative fuel configurations could use the present description to advantage.

The invention claimed is:

1. A method for providing spark to an engine, comprising:

receiving input from one or more engine sensors to a controller; and commanding via the controller shunting, integrating, charging, and discharging of an ignition coil during a cylinder cycle in response to the input, the commanding accomplished via a single conductor providing electrical communication between the controller and an ignition coil drive circuit.

2. The method of claim 1, where the charging and discharging of the ignition coil is commanded via a dwell pulse over the single conductor.

3. The method of claim 1, where the shunting provides a low resistance electrical path between a first side of a primary coil of an ignition coil and a second side of the primary ignition coil.

4. The method of claim 3, where the shunting is performed during an engine crankshaft interval where engine knock is expected.

5. The method of claim 1, where the one or more engine sensors includes an engine crankshaft position sensor.

6. The method of claim 1, where the ignition coil drive circuit includes a pulse decoder circuit.

7. The method of claim 1, where the commanding is provided via one or more voltage pulses over the single conductor.

8. The method of claim 1, where shunting includes closing a switch between a first side of a primary coil of an ignition coil and a second side of the primary ignition coil.

9. A method for providing spark to an engine, comprising:

receiving input from one or more engine sensors to a controller; and commanding via the controller shunting, integrating, charging, and discharging of an ignition coil during a cylinder cycle in response to the input, the commanding accomplished via a single conductor providing electrical communication between the controller and an ignition coil drive circuit and three or more voltage pulses.

10. The method of claim 9, further comprising commanding via the controller an ion signal integration timing, where the ion signal integration timing is shortened so as to not integrate an entire late combustion ion wave form during the cylinder cycle, where a third voltage pulse of the at least three or more voltage pulses is a voltage pulse for starting or ending ignition coil shunting or a voltage pulse for starting or ending ion signal integration, and where a fourth voltage pulse of the at least three or more voltage pulses is a voltage pulse for staring ignition coil shunting or ion signal integration.

11. The method of claim 10, where the shunting and ion signal integration timing is later in time than a pulse representing ignition timing dwell, where a third voltage pulse of the at least three or more voltage pulses is a voltage pulse for starting ignition coil shunting or ion signal integration.

12. The method of claim 9, where a first voltage pulse of the three or more voltage pulses is an ignition timing dwell pulse, and where a third voltage pulse of the three or more voltage pulses is a pulse for ending ignition coil shunting or ion signal integration.

13. The method of claim 12, where a second voltage pulse of the three or more voltage pulses is a pulse for start of ignition coil shunting, ion signal integration, or both ignition coil shunting and ion signal integration, where a third voltage pulse of the three or more voltage pulses is a pulse for ending ignition coil shunting, ion signal integration or ending both ignition coil shunting and ion signal integration, where a fourth voltage pulse of the three or more voltage pulses is a pulse for ending ignition coil shunting and ending ion signal integration or ending both ignition coil shunting and ion signal integration, where a fifth voltage pulse of the three or more voltage pulses is a pulse for ending ignition coil shunting or ion signal integration.

14. The method of claim 9, where the three or more voltage pulses include a pulse for an ignition dwell, a pulse shorter than the pulse for the ignition dwell for start of primary ignition coil shunting, a pulse shorter than the pulse for the ignition dwell for start of ion signal integration, a pulse shorter than the pulse for the ignition dwell for end of primary ignition coil shunting primary ignition coil shunting, and a pulse shorter than the pulse for the ignition dwell for end of ion signal integration.

15. The system for supplying spark to an engine, comprising:

a controller;

an ignition circuit including a pulse decoding circuit and ion signal integration circuitry;

a single conductor electrically coupling the controller and the ignition coil pre-driver circuit;

an ignition coil including a primary coil; and an ignition coil shunting switch in electrical communication with the pulse decoding circuit.

16. The system of claim 15, further comprising a controller including executable instructions stored in non-transitory memory to command spark timing, ignition coil shunting, and ion signal integration via the single conductor.

17. The system of claim 16, where executable instructions stored in non-transitory memory include instructions to output a voltage pulse for spark timing and a voltage pulse for ignition coil shunting.

18. The system of claim 15, where the ignition coil shunting switch is electrically coupled to a first side of the primary coil and to a second side of the primary coil.

19. The system of claim 15, further comprising a controller including executable instructions stored in non-transitory memory to provide a voltage pulse to command spark timing, a voltage pulse to command ignition coil shunting, and a voltage pulse to command ion signal integration.

20. The system of claim 15, further comprising an ignition spark switch in electrical communication with the pulse decoding circuit.

* * * * *